US005989020A

United States Patent [19]

Glass et al.

[11] Patent Number: 5,989,020

[45] Date of Patent: Nov. 23, 1999

[54] MULTIPLE STAGE HEATING APPARATUS

[75] Inventors: Robert Glass, Old Hickory, Tenn.; Wayne Hollingshead, Guelph, Canada

[73] Assignee: Lochinvar Corporation, Nashville, Tenn.

[21] Appl. No.: 09/134,717

[22] Filed: Aug. 14, 1998

[51] Int. Cl.[6] ..... F27B 3/20

[52] U.S. Cl. ..... 432/161; 122/17; 126/350 R

[58] Field of Search ..... 432/72, 101, 161–163, 432/164, 185, 217, 249; 110/210; 431/278, 282, 62; 126/350 R; 122/95.1, 17, 235.34, 235.32, 503, 13.1; 210/182, 189

[56] References Cited

U.S. PATENT DOCUMENTS

| | | | |
|---|---|---|---|
| 3,844,233 | 10/1974 | Fishback . | |
| 4,295,606 | 10/1981 | Swenson . | |
| 4,549,525 | 10/1985 | Narang . | |
| 4,557,203 | 12/1985 | Mainord | 432/72 |
| 4,660,541 | 4/1987 | Moore | 122/17 |
| 4,678,116 | 7/1987 | Krishnakumar et al. . | |
| 4,716,858 | 1/1988 | Bartels . | |
| 4,909,191 | 3/1990 | Le Mer | 126/350 R |
| 5,570,659 | 11/1996 | Cohen . | |

FOREIGN PATENT DOCUMENTS

| | | | |
|---|---|---|---|
| 3-50413 | 3/1991 | Japan | 431/62 |

OTHER PUBLICATIONS

Lochinvar "Copper–Fin II" brochure, Aug. 1997, 6 pages.

*Primary Examiner*—Teresa Walberg
*Assistant Examiner*—Gregory A. Wilson
*Attorney, Agent, or Firm*—Harness, Dickey & Pierce

[57] ABSTRACT

A heating apparatus includes at least first and second burners located in a combustion chamber wherein the burners are separated by a divider for deterring uncombusted fuel flowing from a firing burner to an area adjacent to a non-firing burner. In another aspect of the present invention, the burners are used to heat water in a multiple staged heater.

24 Claims, 3 Drawing Sheets

MULTIPLE STAGE HEATING APPARATUS

BACKGROUND OF THE INVENTION

This invention relates generally to heating apparatuses and more specifically to a multiple stage hot water supply heater.

It is known to provide commercial, gaseous and liquid fossil fuel heaters which use multiple burners in a combustion chamber for heating water. The heated water typically runs through tubes which are also disposed in the combustion chamber. The burners are of a premix air and gas variety, and one or more fans supply air to an air chamber in communication with orifices in the burners.

It is desirable to vary or reduce the firing or burning rate of the burners in order to match the load placed on the appliance. This can be done by varying the input to the burners, by turning off individual burners, or by a combination of modulation and discrete step firing rate reduction. The modulation approach varies the amount of fuel and/or air supplied to the burners rather than turning them only on or off. However, modulation usually requires expensive controls and monitoring equipment to insure safe and efficient operation. Furthermore, it would be very expensive to build an appliance with many individually controlled zones due to the complexity of controls necessary to properly balance the unit for the variable input construction.

The approach of turning off individual burners within one controlled zone upsets the balance but is otherwise fairly economical. The combustion chamber pressure imbalance can force the products of combustion to migrate from the firing burners toward the zones or areas of the non-firing burners and can recirculate back into the path of the fired burners. Thereafter, the products of incomplete combustion are allowed to escape from the unit, past the non-firing burners, which is unacceptable from an environmental emissions standpoint. In other words, the pressure zone above the non-firing burners (i.e., a flame and fuel are not present) is lower than that above the firing burners when one set of burners is not firing. This induces movement of unburned combustion products toward the lower pressure zone. Similarly, the pressure in the area below the non-firing burners can be lower than the areas where the burners are firing. This also induces movement of the uncombusted products from below the firing burners toward the lower pressure zone.

SUMMARY OF THE INVENTION

In accordance with the present invention, a heating apparatus includes at least first and second burners located in a combustion chamber wherein the burners are separated by a divider for deterring uncombusted fuel flowing from a firing burner to an area adjacent to a non-firing burner. In another aspect of the present invention, the burners are used to heat water in a multiple stage heater. A further aspect of the present invention provides premix burners separated by a divider wall upwardly projecting from a floor in a single combustion chamber. A method of operating a heating apparatus which redirects the air flow between burner sets is also provided.

The multiple stage heater of the present invention is advantageous over traditional devices by minimizing the amount of incompletely combusted products that are allowed to escape the combustion chamber. The divider of the present invention deters the flow of recirculated air and accompanying uncombusted fuel from flowing toward the non-firing burners and then exiting through the flue outlet.

Notwithstanding, the configuration of the divider is such as to allow cross ignition between burner sets when multiple sets of burners are operated. The present invention boiler also advantageously employs a mechanism for providing a constant flow of fuel to the burners while allowing for a reduction of air flow volume for reduced stage burning. Thus, heater heating efficiency is maximized while allowing multiple staging at multiple fuel and/or air inputs to meet higher or lower demands on the heater. The air and unburned gas flow patterns due to the present invention enhance the effectiveness and economics of modulation and discrete step firing type heaters. Additional advantages and features of the present invention will become apparent from the following description and appended claims, taken in conjunction with the accompanying drawings.

DETAILED DESCRIPTION OF THE PREFERRED EMBODIMENT

Figure 1:
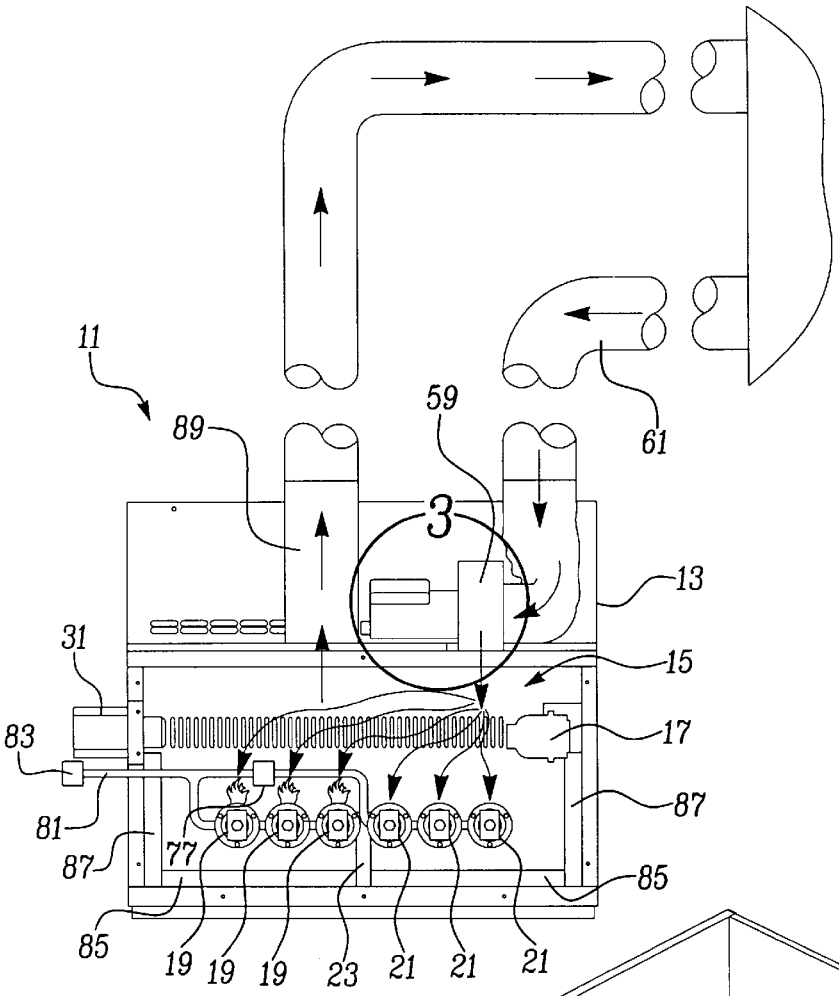
FIG. 1 is a diagrammatic side view showing the preferred embodiment of a multiple stage heater of the present invention.
Figure 2:
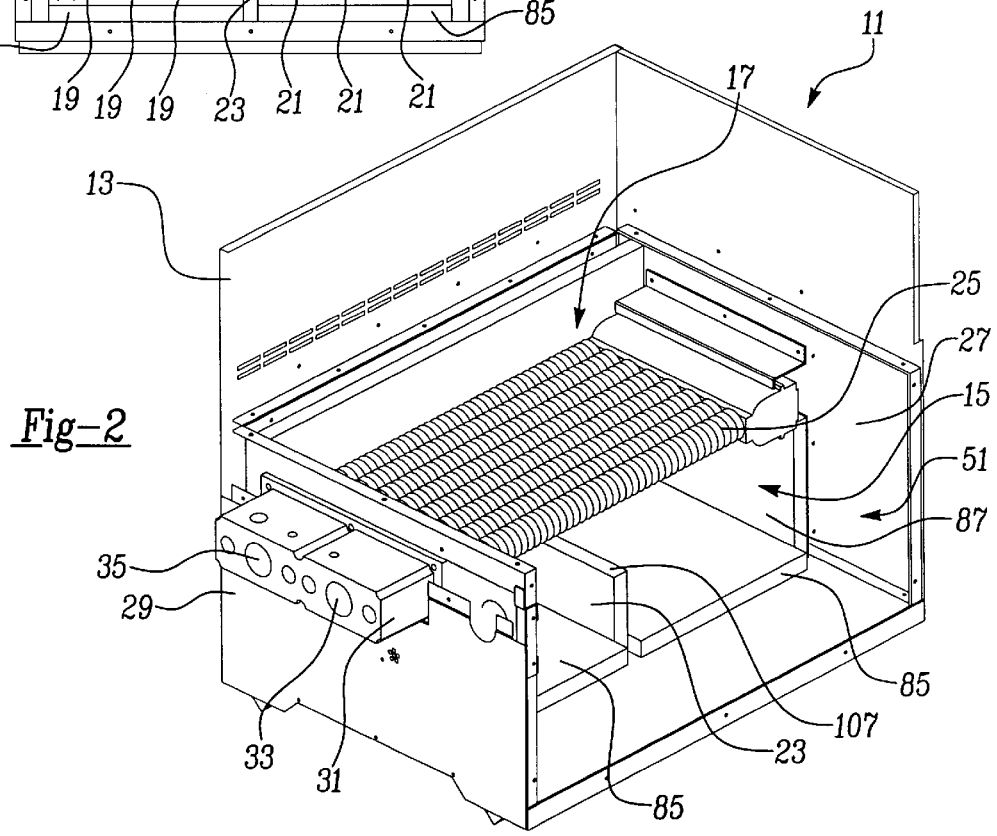
FIG. 2 is a diagrammatic side view, taken 90 degrees from FIG. 1, showing the preferred embodiment multiple stage heater.
Figure 3:
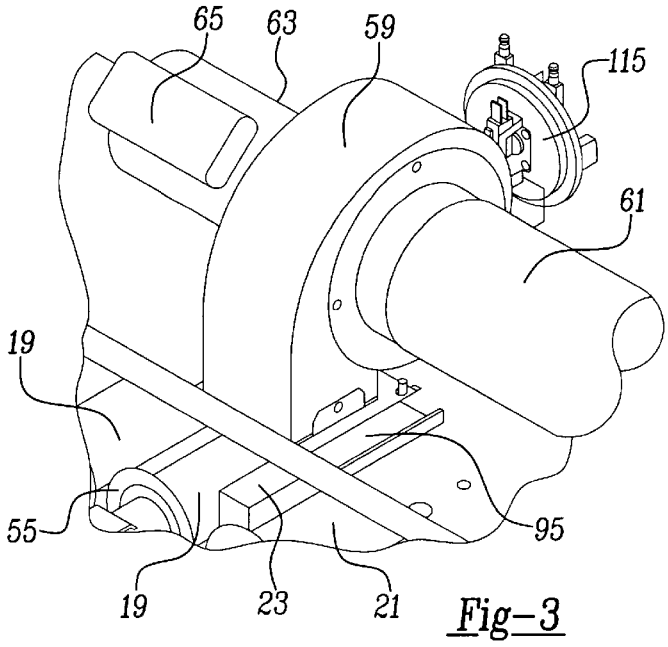
FIG. 3 is a fragmentary perspective view, taken within circle 3 of FIG. 1, showing a portion of the preferred embodiment multiple stage heater.

The preferred embodiment of a multiple stage heater 11 of the present invention can best be observed by referring to FIGS. 1–4. Heater 11 provides a heating capacity for heating fluids such as water and the like in the range between about 150,000 to 750,000 BTU per hour and is envisioned for use in light industrial, commercial and residential applications. Heater 11 includes a heavy gauge, galvanized steel jacket 13, a single combustion chamber 15, a heat exchanger 17, a first set of burners 19, a second set of burners 21, and a divider wall 23. Heat exchanger 17 preferably includes eight parallel, intertwined copper-fin tubes 25 horizontally spanning between vertical side walls 27 and 29 in combustion chamber 15. Tubes 25 operably carry water or other liquids from a one-piece, cast-iron header 31 having a water inlet 33 and a water outlet 35. Tubes 25 are preferably made by Wolverine Tube, Inc. of Alabama, Model No. C12200 FINN 61-0714068. Tubes from other manufacturers can also be employed.

An air chamber or manifold 51 is also disposed within jacket 13 adjacent to combustion chamber 15. Air chamber 51 and combustion chamber 15 are separated by a refractory ceramic fiber tile 53 and a combustion chamber access panel (shown in FIG. 4 but both are removed from FIG. 2). Burners 19 and 21 project into combustion chamber 15 in a horizontally elongated and parallel manner from air chamber 51. Each burner is bolted to the combustion chamber access panel by a burner flange 55. An end of each burner is positioned in air chamber 51 for operably receiving air flow provided by a multiple or proportional speed, squirrel cage fan 59 and gas from an orifice positioned in each burner. Air is provided to fan 59 through an optional inlet duct 61 in communication with atmospheric ambient air. A fractional horsepower, alternating current electric motor 63, with an associated capacitor 65, serves to operate fan 59. An air shutter 95 (see FIG. 3) is positioned between fan 59 and air chamber 51.

Preferably, a gas manifold 81 provides natural gas fuel from a regulator 83 and an associated valve to orifices 57 of burners 19 and 21. A second valve 77 is provided in manifold 81, between first and second sets of burners, respectively 19 and 21, for selectively preventing the gas from flowing to the second set of burners 21 when lower stage firing or heating is desired. Burners 19 and 21 are of a premix variety and are preferably made by Burner Systems Inc. of Chattanooga, Tenn., Model No. 213632393-01. However, burners from other manufacturers can also be employed. These burners have a hole and slot pattern along the top of their cylindrically cross sectional shapes through which the firing flames project, when burning fuel. Alternately, other gaseous or liquefied fossil fuels can be used, such as oil, propane or the like.

Ceramic fiber floor tiles 85 and ceramic fiber side wall tiles 87 are provided in combustion chamber 15. Divider 23 is similarly made of a one inch thick ceramic fiber tile and generally extends upward from floor tiles 85 in a vertical manner. Divider wall 23 is frictionally held in place between central edges of floor tiles 85. Ceramic fiber tiles 23, 53, 85 and 87 are preferably made by Refractory Specialists, Inc. of Sebring, Ohio, Model No. FG23-101 or FG23-107. While this tile manufacturer and composition are suitable for the refractory temperatures of between 1500 and 1600° F. typically encountered, other divider materials such as steel or screens, as well as alternate manufacturers, can be used, depending on the temperatures and applications. However, ceramic tiles are more lightweight, durable and easier to mount than would be a sheet metal divider. Furthermore, an outlet flue 89 is provided to exhaust the burned or combusted gas and air mixture to the atmosphere from combustion chamber 15. A hot surface ignition system (not shown) is also preferably employed in combustion chamber 15 for igniting the burners, but other ignition systems can be used such as pilot lights or direct spark methods. An air pressure switch 115 turns off the ignition control system if the vent is restricted.

Tubes 25 are located approximately four to six inches below the top of combustion chamber 15 while burners 19 and 21 are disposed approximately six to eight inches below tubes 25. For diagnostic purposes, a first flexible hose 97 (see FIG. 4) is coupled to a pressure gauge 99 to measure air chamber pressure while a second flexible hose 101 is coupled to gauge 99 in order to measure burner venturi pressure. Moreover, a hose (not shown) that senses pressure in the air chamber is coupled to the top of gas regulator 83 (see FIG. 1) for maintaining a constant regulator pressure and constant gas input referenced to air chamber pressure variances due to wind gusts, changes in the length of the flue, flue blockage and the like; such variances create changes in pressure in the air chamber thereby changing the gas flow rate to the burners if the regulator is not referenced.

Figure 4:
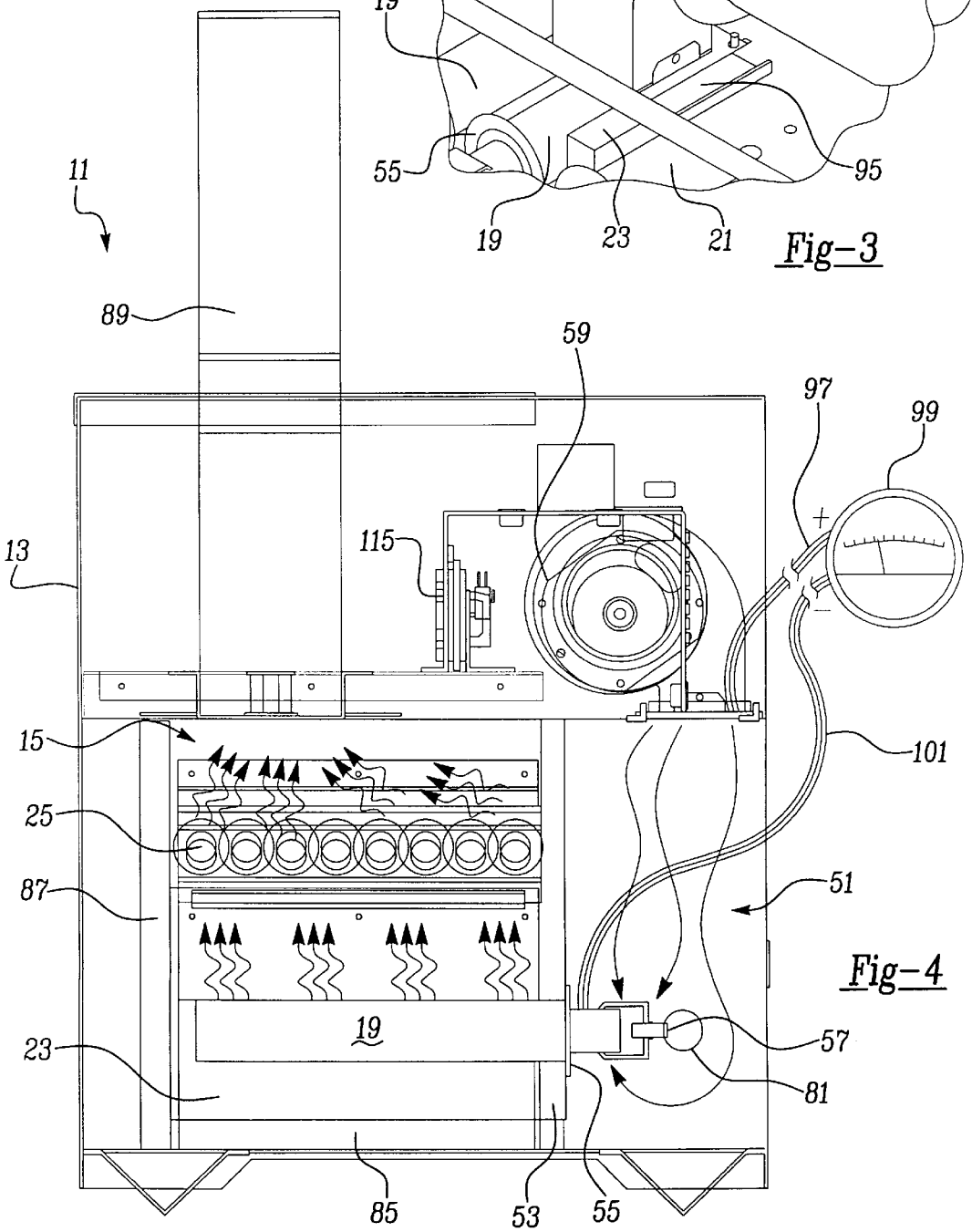
FIG. 4 is a perspective view showing portions of the preferred embodiment multiple stage heater.
Figure 5:
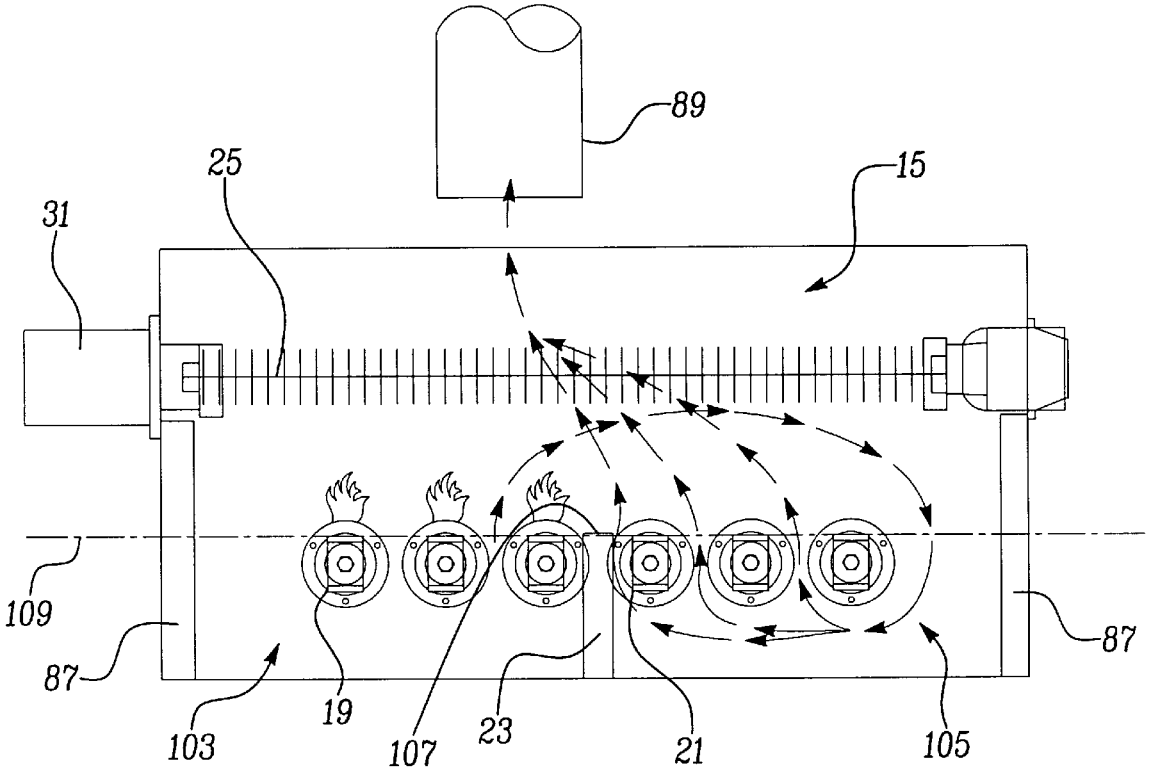
FIG. 5 is an enlarged diagrammatic side view, similar to that of FIG. 1, showing the preferred embodiment multiple stage heater.

FIGS. 1, 4 and 5 illustrate the air flow patterns within heater 11 of the present invention. Fresh atmospheric air enters inlet duct 61 and is forced into air chamber 51 by fan 59. This air then flows into each venturi of burners 19 and 21 regardless of whether one or both sets of burners are firing. If only one set of burners 19 is firing, as is shown, then fan 59 can operate at a slower speed to reduce the amount of air flow into burners 19 and 21. When second set of burners 21 is not firing, then gas is flowed through manifold 81 and to only first set of burners 19 where they are combusted inside of combustion chamber 15. Divider wall 23 serves to maintain any uncombusted fuel within an area 103 adjacent to first set of burners 19 until the fuel is entirely or predominately burned. Thereafter, the combusted fuel and air gases will rise over divider wall 23 due to the lower pressure present in the area 105 immediately adjacent second set of burners 21. The mixed and heated effluent then passes by tubes 25 for heating the water internally contained therein and exists through outlet flue 89 into the atmosphere. Divider wall 23 promotes more complete combustion of the natural gas prior to exiting combustion chamber 15. However, a top edge 107 of divider wall 23 is ideally of a height equivalent to a horizontal plane 109 disposed between the top surfaces of burners 19 and 21; this allows cross ignition, in other words transmission of the flame, from the firing burners 19 to the previously non-firing burners 21 when gas is supplied to both sets of burners for high stage heating.

Figure 6:
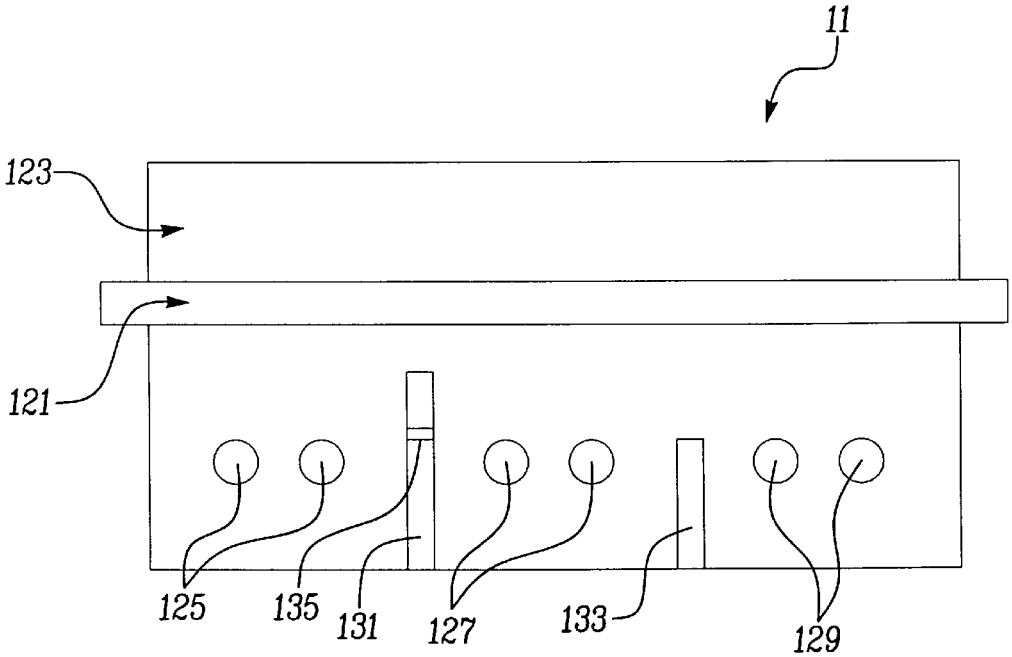
FIG. 6 is a diagrammatic side view, similar to that of FIG. 5, showing an alternate embodiment of the multiple stage heater of the present invention.

An alternate embodiment of the multiple stage heater 11 is shown in FIG. 6. As with the preferred embodiment, a series of elongated water carrying tubes 121 are disposed in a combustion chamber 123. Three sets of burners 125, 127 and 129 are also disposed in combustion chamber 123 running perpendicular to tubes 121. A first divider wall 131 is vertically mounted between first and second burner sets, 125 and 127 respectively, while a second divider wall 133 vertically projects between second and third burner sets, 127 and 129 respectively. Divider wall 131 is shown as being higher than a plane between the burner tops but has one or more apertures 135 for allowing cross ignition between burner sets without significantly affecting the air flow patterns induced by the divider. This divider configuration can also be employed in the preferred embodiment. The present exemplary embodiment provides multi (or three) stage proportional firing wherein each of the burner sets can be independently firing or non-firing regardless of the other while improving the combustion of fuel within the areas immediately above and below the firing burners. It is also alternately envisioned that two or more fans with multiple speeds and stages can also be employed with either of the embodiments.

Various embodiments of the present invention water heater have been disclosed, however, it should be appreciated that other variations may be employed. For example, alternate burner or water carrying tube shapes, numbers and mounting arrangements can be employed. Furthermore, a divider can be positioned, mounted or shaped differently than that preferably disclosed as long as the desired function is achieved. While various materials, suppliers and model numbers have been disclosed, a variety of other such materials, suppliers and model numbers may be used. It is intended by the following claims to cover these and any departures from the disclosed embodiments which fall within the true spirit of this invention.

The invention claimed is:

1. A heating apparatus comprising:

a substantially enclosed combustion chamber having a flue outlet;

a first burner located in said combustion chamber;

a second burner located in said combustion chamber; and a divider located between said first and second burners serving to deter unburned fuel flowing from a first area adjacent said first burner to a second area adjacent said second burner when said first burner is combusting fuel and said second burner is not combusting fuel.

2. The apparatus of claim 1 wherein said fuel includes one of gaseous and liquid fossil fuels.

3. The apparatus of claim 2 wherein said burners are of a premix air and fuel gas variety.

4. The apparatus of claim 1 further comprising a floor of said combustion chamber located on a substantially opposite side of said combustion chamber from said outlet, said divider upwardly projecting from said floor and between said first and second burners.

5. The apparatus of claim 4 wherein said divider projects no higher than a horizontal plane defined by top surfaces of said burners.

6. The apparatus of claim 1 wherein said divider has at least one aperture for allowing cross ignition between said burners, said cross ignition being otherwise obstructed by said divider.

7. The apparatus of claim 6 wherein a top of said divider projects higher than said burners.

8. The apparatus of claim 1 further comprising:

an air chamber located adjacent said combustion chamber;

an orifice of each of said burners located in said air chamber; and a fan supplying air to said air chamber, said fan supplying a first volume of air to said air chamber if only said first burner is combusting said fuel, said fan supplying a second volume of air greater than said first volume if said first and second burners are combusting said fuel.

9. The apparatus of claim 8 further comprising:

at least third and fourth burners located parallel to said first burner in said first area of said combustion chamber; and at least fifth and sixth burners located parallel to said second burner in said second area of said combustion chamber, said first and second areas of said combustion chamber being substantially separated by said divider.

10. The apparatus of claim 1 further comprising a set of water carrying tubes positioned in said combustion chamber substantially between said burners and said outlet, said tubes being elongated in a direction substantially perpendicular to an elongated direction of said burners, said burners acting to heat said water when combusting said fuel, said apparatus being defined as a multiple stage heater.

11. The apparatus of claim 1 wherein said divider is a substantially straight and rectangular piece of ceramic fiber tile.

12. The apparatus of claim 1 further comprising:

a third burner selectively operable to combust fuel when firing, fuel being selectively prevented from flowing through said third burner even if said first and second burners are combusting fuel; and a second divider located between said second and third burners, said dividers projecting in a substantially vertical and parallel manner between said burners.

13. A heating apparatus comprising:

a flue outlet;

a single combustion chamber coupled to said flue outlet, said combustion chamber having a first internal area, a second internal area and a floor;

a burner assembly including a first set of burners located in said first internal area of said combustion chamber, and a second set of burners located in said second internal area of said combustion chamber; and a divider projecting upward from said floor in a substantially vertical manner substantially between said first set of burners and said second set of burners.

14. The heating apparatus of claim 13 wherein said divider has at least one aperture formed therethrough to allow cross ignition between said first and second set of burners, said cross ignition being otherwise obstructed by said divider.

15. The heating apparatus of claim 14 wherein a top of said divider projects above said burner assembly.

16. The heating apparatus of claim 13 wherein said divider projects no higher than a horizontal plane substantially defined by a top surface of said burner assembly to allow cross ignition between said first and second set of burners over said divider.

17. The heating apparatus of claim 13 further comprising:

a heat exchanger located between said burner assembly and said flue outlet;

an air chamber located adjacent said single combustion chamber and in fluid communication therewith; and a fan supplying combustion air to said air chamber.

18. The heating apparatus of claim 13 wherein said apparatus is a negative draft venting device.

19. The heating apparatus of claim 13 further comprising:

a fuel pressure regulator operably feeding a fuel to said burner assembly; and a valve operably coupled to said burner assembly for varying the flow of said fuel in response to a pressure change in said single combustion chamber.

20. A method of operating a heating apparatus, said method comprising:

(a) directing fuel from a fuel source to a first burner;

(b) directing air from an air chamber to said first burner;

(c) firing said first burner to ignite said air and fuel flowing thereto in a first portion of a combustion chamber;

(d) providing a wall located between said first burner and a second burner for maintaining uncombusted fuel within said first portion of said combustion chamber;

(e) flowing air from said air chamber to said second burner;

(f) determining if the heating apparatus is operating in a high stage firing condition;

(g) selectively directing fuel from said fuel source to said second burner if the heating apparatus is operating in said high stage firing condition; and (h) firing said second burner to ignite said air and fuel flowing thereto in a second portion of said combustion chamber if the heating apparatus is operating in said high stage firing condition.

21. The method of claim 20 further comprising firing said second burner through cross ignition from said first burner if the heating apparatus is operating in said high stage firing condition.

22. The method of claim 20 further comprising operating a fan located outside of said air chamber to flow air into said first and second burners.

23. The method of claim 20 further comprising increasing the flow of air if the heating apparatus is operating in said high stage firing condition.

24. The method of claim 20 further comprising generating a negative pressure in said combustion chamber to vent the heating apparatus.

* * * * *